US009364884B1

(12) United States Patent
Cooper, Jr.

(10) Patent No.: US 9,364,884 B1
(45) Date of Patent: Jun. 14, 2016

(54) STAMPING SLUG RETENTION RECESS

(71) Applicant: Donald Cooper, Jr., York, PA (US)

(72) Inventor: Donald Cooper, Jr., York, PA (US)

( * ) Notice: Subject to any disclaimer, the term of this patent is extended or adjusted under 35 U.S.C. 154(b) by 0 days.

(21) Appl. No.: 14/242,925

(22) Filed: Apr. 2, 2014

Related U.S. Application Data

(60) Provisional application No. 61/813,033, filed on Apr. 17, 2013.

(51) Int. Cl.
*B21D 45/08* (2006.01)
*B21D 28/14* (2006.01)

(52) U.S. Cl.
CPC ..... *B21D 28/145* (2013.01)

(58) Field of Classification Search
CPC .... B21D 28/06; B21D 45/006; B21D 28/145; B26D 2007/1881; B26D 7/1818; Y10T 83/2055; Y10T 83/2213; Y10T 83/9425; Y10T 83/9437; Y10T 83/2179; B26F 2210/08
USPC ..... 83/145, 93, 149, 164, 683, 690, 146, 83/97, 685
See application file for complete search history.

(56) References Cited

U.S. PATENT DOCUMENTS

| | | | | |
|---|---|---|---|---|
| 2,404,793 | A * | 7/1946 | Dickerman | 83/685 |
| 2,604,167 | A * | 7/1952 | Oliver | 83/86 |
| 4,543,865 | A * | 10/1985 | Kramski | 83/146 |
| 4,821,615 | A | 4/1989 | Bakermans et al. | |
| 4,947,720 | A * | 8/1990 | Howe | 83/146 |
| 4,974,479 | A | 12/1990 | Bakermans et al. | |
| 5,035,163 | A | 7/1991 | Bakermans | |
| 5,136,907 | A | 8/1992 | Bakermans et al. | |
| 6,397,715 | B1 * | 6/2002 | Roberts | 83/149 |
| 6,997,363 | B1 | 2/2006 | Vossen | |

* cited by examiner

*Primary Examiner* — Ghassem Alie
(74) *Attorney, Agent, or Firm* — Hooker & Habib, P.C.

(57) ABSTRACT

Provided is a die trim section with a recess adapted to retain slugs in a stamping process. The recess may be added to existing die inserts via wire EDM, conventional surface grinding or other suitable methods. The lateral depth of the recess in the trim section is approximately equal to the cutting clearance of a die trim or blank insert. The recess is preferably tapered inward toward the die opening, wherein the upper portion is at the die level and the bottom portion is within the die trim insert interior. The recess creates a small tab on a slug that is wedged into the trim section, preventing the slug from being pulled upwards when the punch is withdrawn. Configurations of the recess vary depending upon slug size and material thickness, cutting clearance, dimensions of the trim section, and dimensions and configuration of the finished product.

16 Claims, 8 Drawing Sheets

STAMPING SLUG RETENTION RECESS

CROSS REFERENCE TO RELATED APPLICATION

This application claims the benefit of U.S. Provisional Application No. 61/813,033 filed on Apr. 17, 2013, entitled "Saige Slug Retention Features." The above identified patent application is herein incorporated by reference in its entirety to provide continuity of disclosure.

BACKGROUND OF THE INVENTION

1. Field of the Invention

The present invention relates to a die trim assembly with a recess adapted to retain slugs in a stamping process. More specifically, the present invention describes an improved stamping die trim assembly that retains a slug within the die trim insert after it has been blanked. The present invention comprises a recess that can be added to new die trim inserts, or is retrofitted to die trim inserts in existing stamping dies. The recess improves stamping process and increases overall production for metal workers in various industries.

Stamping is a form of metalworking that uses a punch and a die to perforate holes or shapes in a part, or blanks out a part using punches. The waste portion that is stamped from the material is the slug. When stamping materials with a punch and a die, loose slugs can be tilted or pulled up and into the working area of a stamping die. This can cause the in-feeding material to jam, which can cause damage to the parts being made. Additionally, a slug that is pulled into the working area of the stamping die can damage or break the die tooling, which is expensive to repair or replace.

The present invention relates to a new and improved die trim assembly with a recess adapted to retain loose slugs during a stamping process. The recess preferably vertically aligned on the die insert. In one embodiment, the recess is created via a vertical conical extrusion, such that the top part of the recess is level with the top surface of the die trim section, and the depth of the recess into trim insert wall remains the same vertically along the interior wall of the die insert. In another embodiment, the recess is created via an angled conical extrusion, such that the top part of the recess remains level with the top surface of the die trim section and the bottom part of the recess is tapered inward into the slug cavity, becoming shallower. In yet another embodiment, the recess is created via an angled cylindrical extrusion. In this embodiment, the top part of the recess still remains level with the top surface of the die trim section, and the bottom part of the recess is tapered inward into the slug cavity, becoming shallower to a lesser depth into the trim wall. In all of the embodiments, the bottom of the recess creates a wedging action to hold a slug, which secures the slug in a die insert when stamping materials with a trim punch and a die. This counteracts the tendency for a trim punch to pull the slug upwards out of the die insert, which reduces damages to stamped parts and the die trim assembly.

The present invention can be added to new or existing die trim inserts by wire electric discharge machining (EDM) or conventional grinding or other suitable methods. The recess in the die trim inserts helps retain slugs, which reduces maintenance costs and expenses while increasing efficiency in production, benefiting manufacturing companies that use dies to stamp material or use any process that creates a slug using trim punches and die trim inserts.

2. Description of the Prior Art

Devices have been disclosed in the prior art that relate to die trim assembly parts to retain slugs. These include devices that have been patented and published in patent application publications. These devices generally relate to die trim assembly parts to retain slugs. However, the prior art fails to provide a device that can be easily added to both new and existing stamping dies that is similar to the present invention, which provides a cost-effective solution to improving the stamping process. The following is a list of devices deemed most relevant to the present disclosure, which are herein described for the purposes of highlighting and differentiating the unique aspects of the present invention, and further highlighting the drawbacks existing in the prior art.

These prior art devices have several known drawbacks. For example, U.S. Pat. No. 4,821,615 to Bakermans and Owzar discloses a slug retainer for the die trim assembly of a stamping and forming machine. This device comprises a slug receiving cavity that receives a slug. After slugs are punched from a material, they are pushed through one or two slug passageways in the die trim assembly. The slug receiving cavity communicates with the die trim assembly so that the slugs are continuously produced and stacked into the slug receiving cavity. Unlike the present invention, this device is needs to be affixed to a portion of the die trim assembly. As such, this device is limited to being anchored onto a new die trim assembly. Additionally, slugs can still be pulled into the working area before entering the slug receiving cavity, damaging the die trim assembly. The present invention is capable of retaining slugs immediately after it is punched from a material. Thus, this invention is not ideal as it cannot be retrofitted to existing die assemblies and problematic in securing loose slugs.

Similarly, U.S. Pat. No. 4,974,479 to Bakermans, Deimler, and Reavis discloses a system for controlling slugs in a stamping and forming machine. This device discloses a slug stripper that strips away any slugs that adhere to the end of the punch and slug supporting bars. One end of the slug stripper is mounted to the surface of the die trim section and the other end extends over the die opening. Because one end of the slug stripper extends over the die opening, it could potentially be snapped off or jammed into the die insert in case of malfunction. Unlike the present invention, the slug stripper needs to be mounted, most likely to a new die trim assembly, and maintained in the surface of the die trim assembly, which could be costly. Additionally, the slug stripper may wear down after repeated use, failing to retain slugs. In addition, the slug stripper can push loose slugs into the working area or loose slugs can adhere to the slug stripper, causing further damage to the entire assembly.

U.S. Pat. No. 5,035,163 to Bakermans discloses a punch and die combination for trimming the edges of strip material. The Bakermans device comprises multiple die opening with upstream and downstream shearing edges and multiple punches that punch out trapezoidal-shaped slugs. Unlike the present invention, the Bakermans device requires multiple die openings, where the loose slugs are stacked in the second die opening. While the second die opening may retain loose slugs, the purpose and design of the Bakermans device diverges in intent and design from the present invention, which discloses a recess for a single die opening adapted to secure loose slugs. The Bakermans device is also limited in the fact that the slugs are much more likely to adhere to the working area because the slugs are pushed through multiple die opening for edge trimming.

U.S. Pat. No. 6,997,363 to Vossen discloses a device for removing break-off components from a sheet of material. The Vossen utilizes a clamping tool to hold a waste portion of a metal after it is broken off. Alternatively, the Vossen device requires a high friction surface to hold waste portions when the clamping tool is not used. However, the invention described in Vossen requires additional parts for use with existing die assemblies and fails to address the issues of counteracting the tendency of the slugs to be withdrawn with the punch. The present invention addresses the issue by retaining loose slugs in a die insert by wedging a slug into a die insert interior without the need or expense to create additional apparatus to hold the slug.

U.S. Pat. No. 5,136,907 to Bakermans, Dubbs, and Holbrook discloses a punch and die trim assembly that pushes the slug into a die trim section opening. The slug is moved laterally across the face of the punch by the rib, and the slug moves against the surface of the opening as it is pushed into the die opening and moves downwardly relative to the inclined rib. This is disadvantageous because the punch and the die insert must be aligned to prevent the punch from shearing the rib, which can damage the punch and the rib. This device also fails to address the issues of the slug adhering to the face of the punch while it is moved against the surface of the opening, and further does not address the ability to remove any loose slugs that adhere to the face of the punch. The present invention does not require moving the slugs laterally across any surface. The slugs are simply pushed into the die insert after it is punched. Additionally, the prior art discloses tapered die insert walls, which reduces the life of the die insert because the opening may be enlarged over use. This increases clearance of the apparatus, which can lead to burrs.

The present invention is adapted to retain slugs that is not limited by the structure of the die trim assembly being installed thereinto. The present invention provides flexibility with regard to the size and shape of the recess and where the recess can be added. Multiple recesses can be added, depending on the size of the loose slugs and the type of material used for stamping. The present invention will greatly assist metal workers using stamping machines or die trim assemblies by retaining and securing loose slugs during a stamping process. It is therefore submitted that the present invention substantially diverges in design elements from the prior art and consequently it is clear that there is a need in the art for an improvement to slug retainer devices. In this regard, the instant invention substantially fulfills these needs.

SUMMARY OF THE INVENTION

In view of the foregoing disadvantages inherent in the known types of slug retainer devices now present in the prior art, the present invention provides a die trim assembly with a recess adapted to retain slugs in a stamping process, wherein the same can be utilized for providing convenience for the user for improving efficiency with regard to the production of stamped materials.

It is therefore an object of the present invention to provide a new and improved die trim assembly with a recess adapted to retain slugs that has all of the advantages of the prior art and none of the disadvantages.

Another object of the present invention is to provide a new and improved die trim assembly with a recess in the die trim insert wall to create a small geometrical offshoot of the slug that is progressively pinched as it is pushed into the die, causing the slug to wedge thereagainst and counteract the tendency of the slug to be withdrawn with the trim punch, either by vacuum, electrostatic attraction, or the like.

Yet another object of the present invention is to provide a new and improved die trim assembly with a recess in the die trim insert wall that is created via a vertical conical extrusion such that the top of the recess has a larger radius than the narrower end of the recess which has a smaller radius, wherein the top of the recess is level with the top surface of the die trim section and the bottom of the recess extends down into the slug cavity while the depth of the recess into the die trim insert wall remains the same from the top to the bottom of the recess.

Yet another object of the present invention is to provide a new and improved die trim assembly with a recess in the die trim insert wall that is created via an angled conical extrusion such that the top of the recess is level with the top surface of the die trim section, the lower tapered end of the recess is less deep along the die trim profile wall, and the radius of the top of the recess is larger than the radius of the bottom of the recess.

Yet another object of the present invention is to provide a new and improved die trim assembly with a recess in the die trim insert wall that is created via an angled cylindrical extrusion such that the extrusion is deeper at the top surface and tapers into the cavity while the depth of the recess becomes shallower toward the bottom of the die trim profile opening.

Yet another object of the present invention to provide a new and improved die trim assembly with a recess that ensures that the slug produced during a stamping operation will be retained in the die, thereby preventing loose slugs from causing the in-feeding material to jam.

Yet another object of the present invention is to provide a series of recesses to new or existing die trim inserts, which are specifically designed to create a pinching action on the slug, by using conventional grinding or by wire EDM, or other suitable methods.

A final object of the present invention is to provide a new and improved die trim assembly with a recess to prevent the loose slugs from damaging the die tooling, which is expensive to repair or replace.

Other objects, features and advantages of the present invention will become apparent from the following detailed description taken in conjunction with the accompanying drawings.

BRIEF DESCRIPTIONS OF THE DRAWINGS

Although the characteristic features of this invention will be particularly pointed out in the claims, the invention itself and manner in which it may be made and used may be better understood after a review of the following description, taken in connection with the accompanying drawings wherein like numeral annotations are provided throughout.

Figure 4:
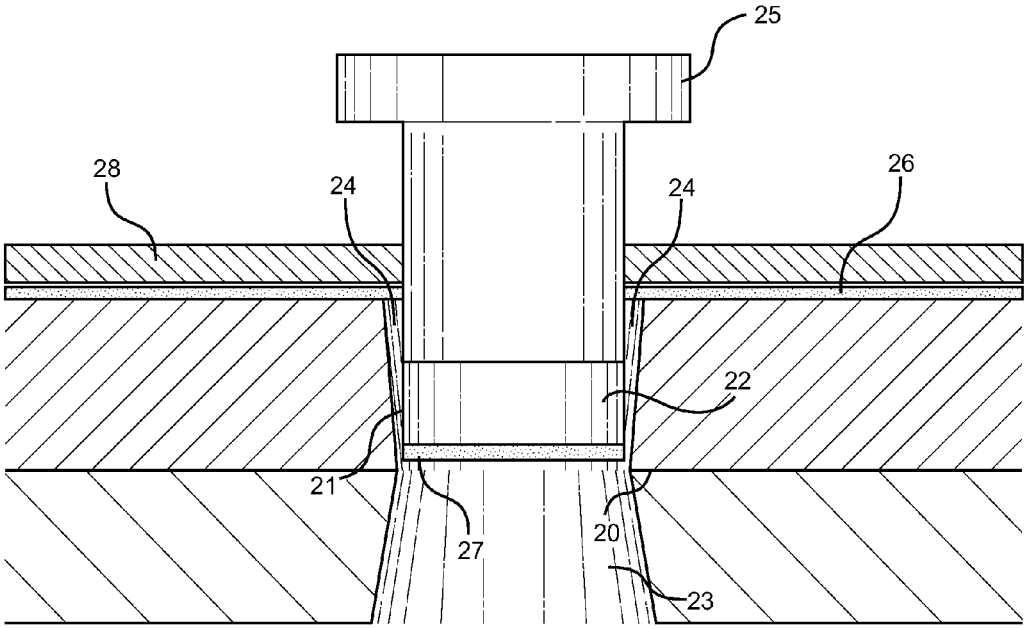

FIG. 4 a side view of the die trim assembly including a sheet of stamping material disposed over a die trim insert and a trim punch therethrough.

Figure 5:
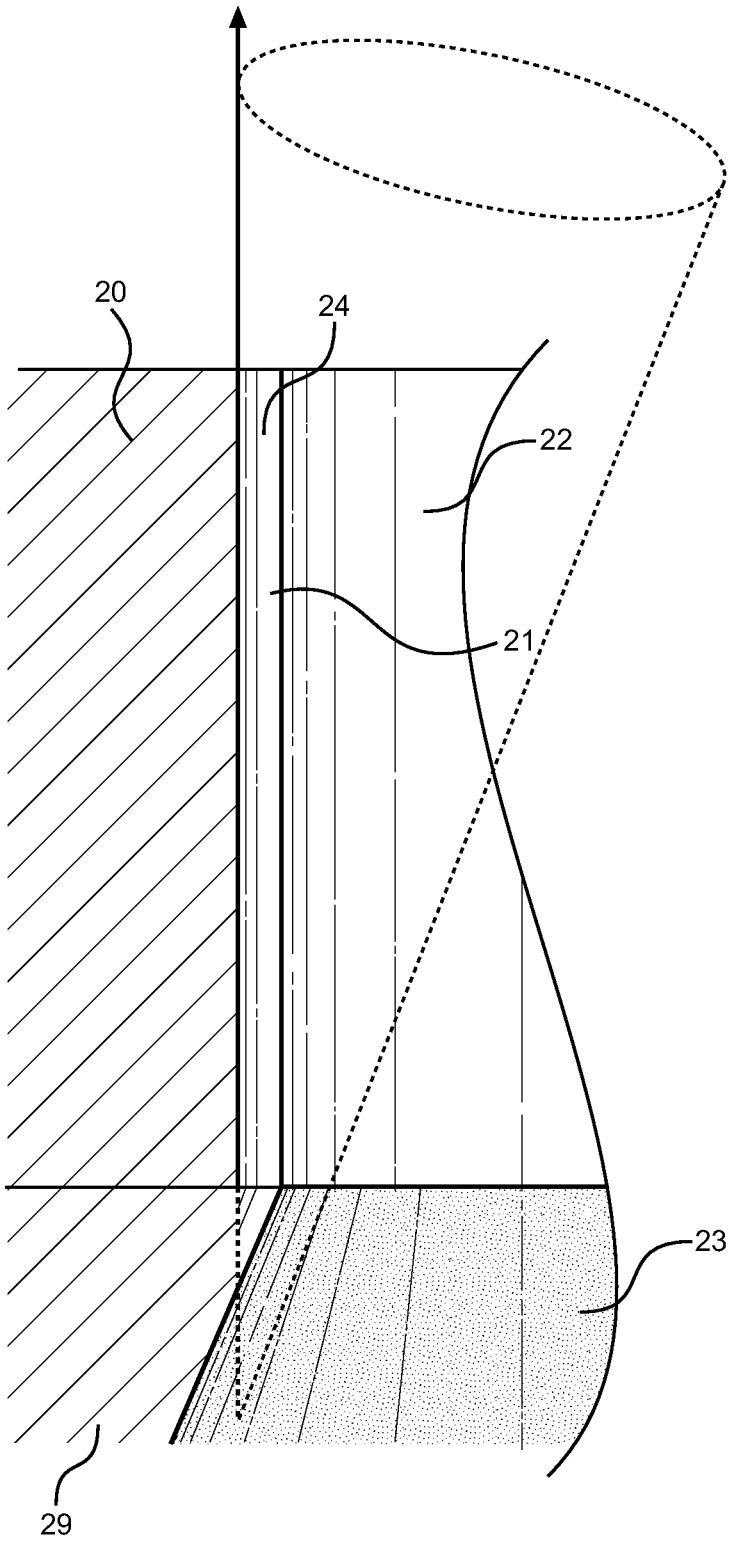

FIG. 5 is a side view of a first embodiment of the recess created via a vertical conical extrusion.

Figure 6:
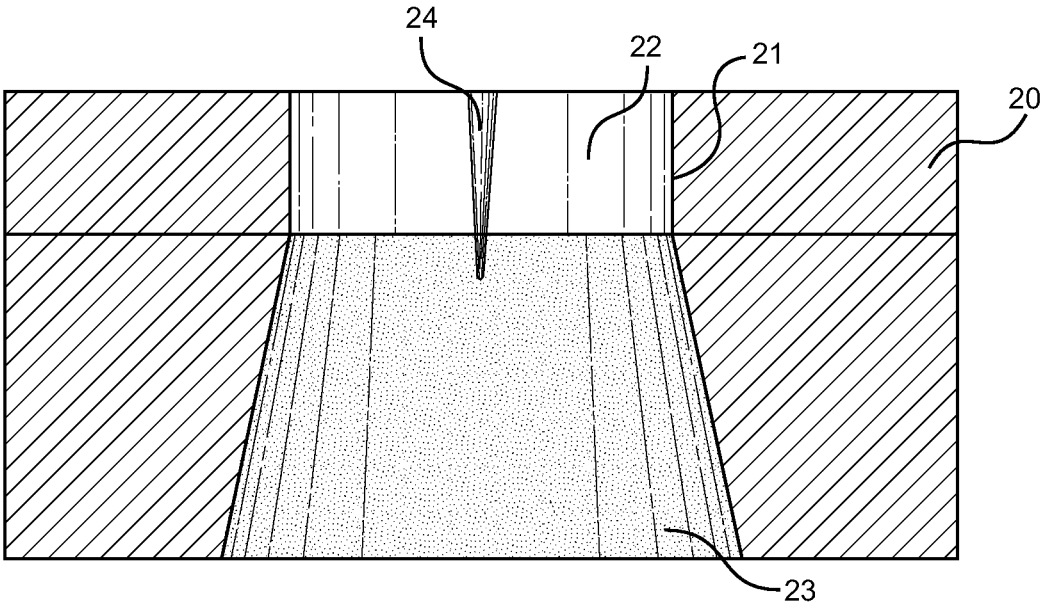

FIG. 6 is a front cross-sectional view of the first embodiment of the recess created via a vertical conical extrusion.

Figure 7:
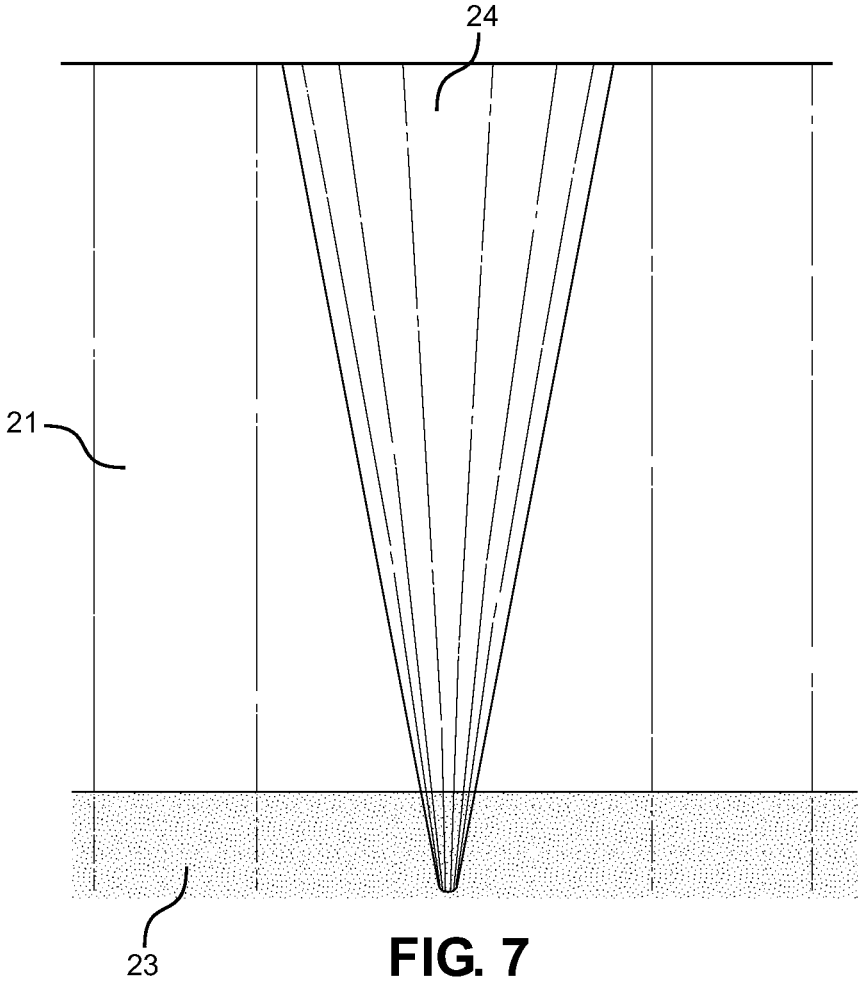

FIG. 7 is a close up front view of an embodiment of the recess created via a vertical conical extrusion.

Figure 8:
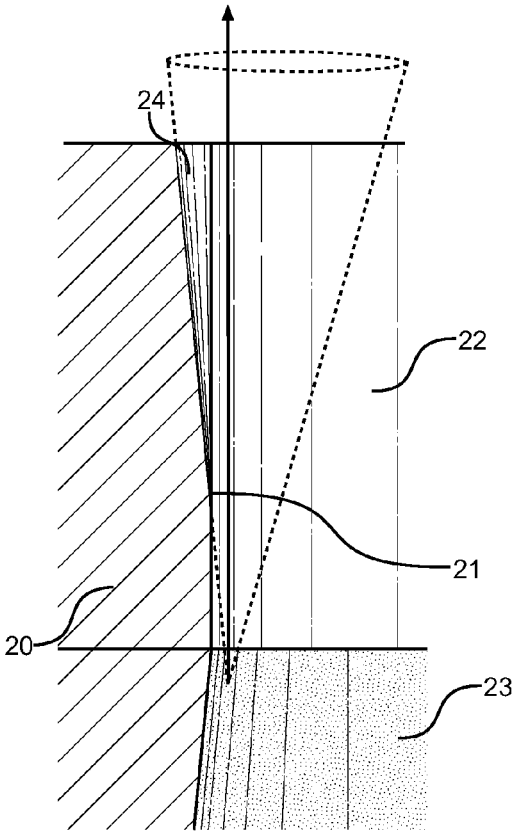

FIG. 8 is a side view of a second embodiment of the recess of the present invention created via an angled conical extrusion along a die insert trim wall.

Figure 9:
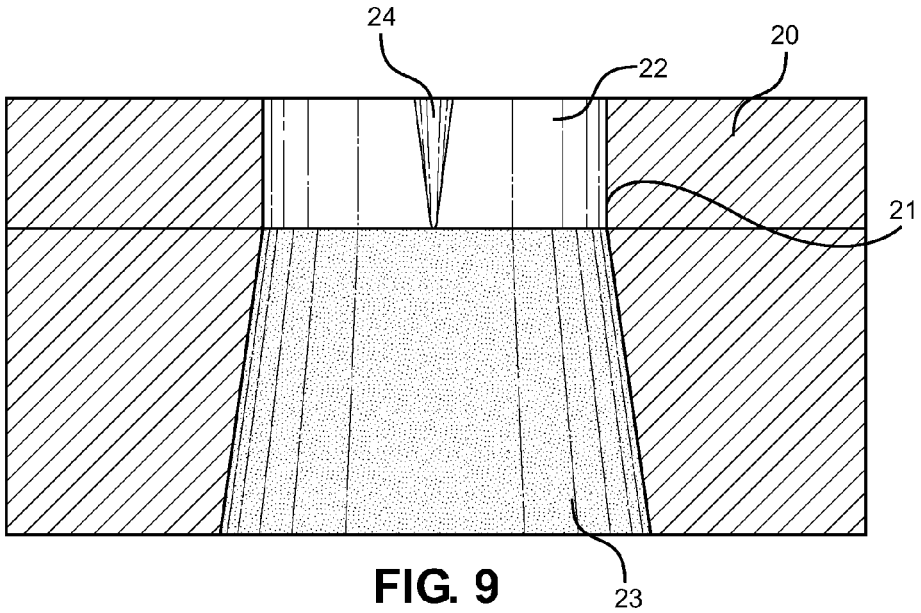

FIG. 9 is a front cross-sectional view of the second embodiment of the recess of the present invention created via an angled conical extrusion.

Figure 10:
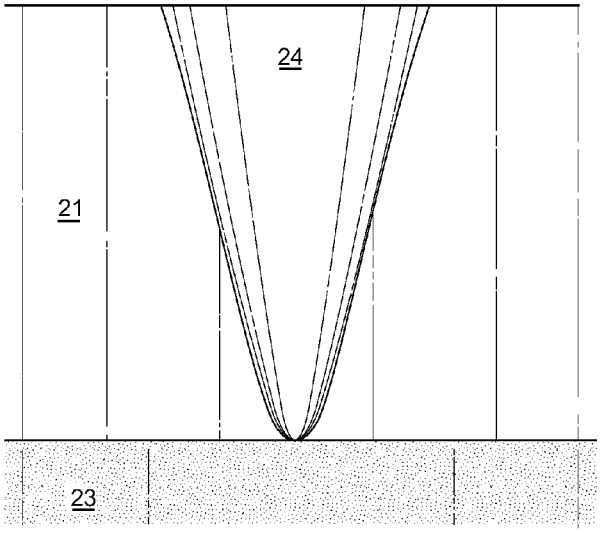

FIG. 10 is a close up view of a front cross-sectional view of the second embodiment of the recess of the present invention created via an angled conical extrusion.

Figure 11:
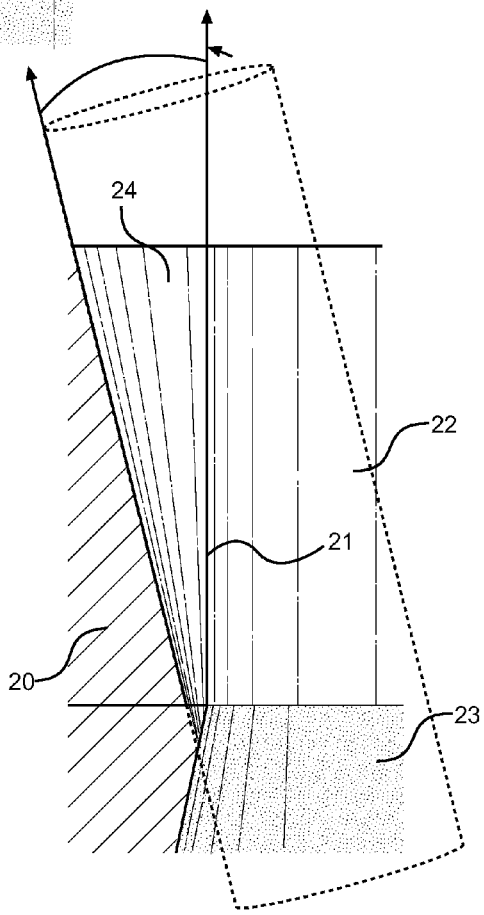

FIG. 11 is a side view of a third embodiment of the recess of the present invention created via an angled cylindrical extrusion along a die insert trim wall.

Figure 12:
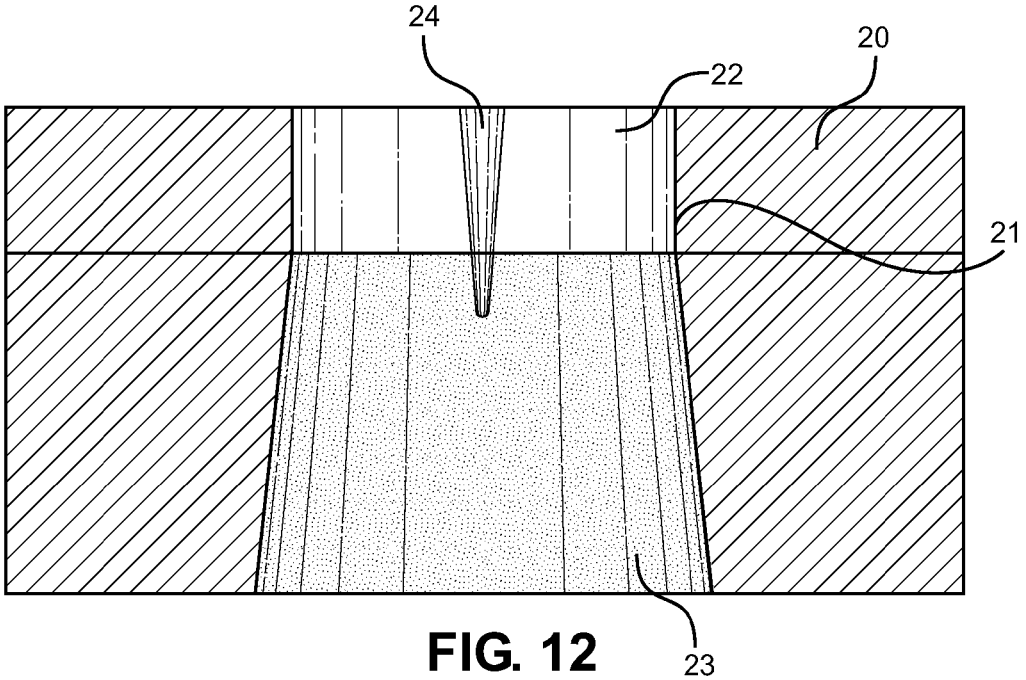

FIG. 12 is a front cross-sectional view of the third embodiment of the recess of the present invention created via an angled cylindrical extrusion.

Figure 13:
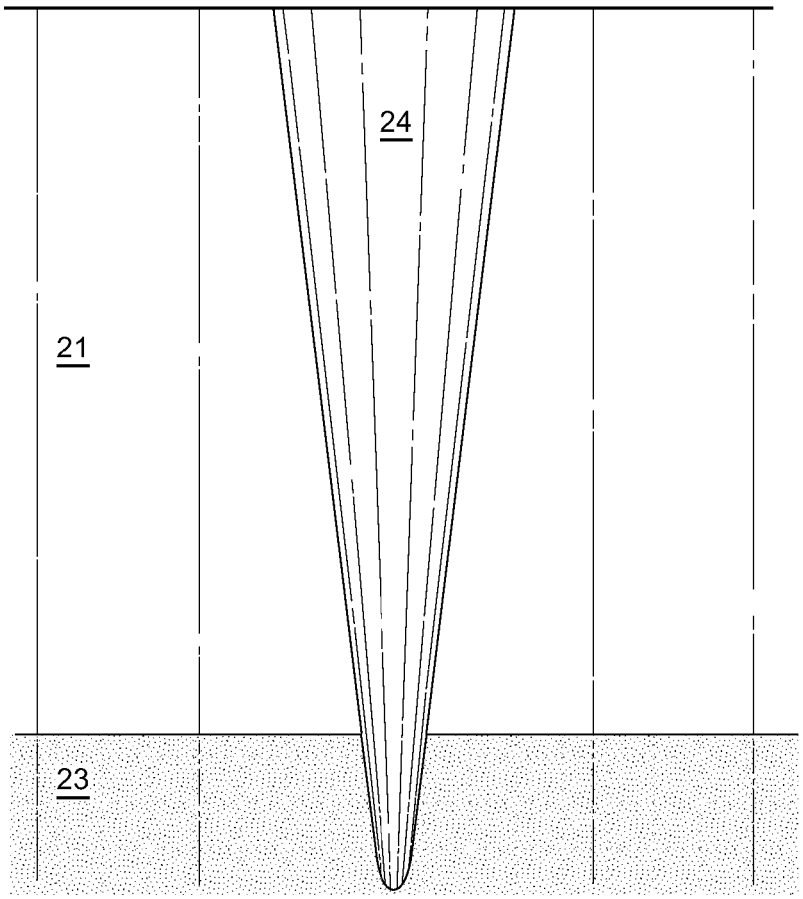

FIG. 13 is a close up view of the third embodiment of the recess of the present invention created via an angled cylindrical extrusion.

Figure 14A:
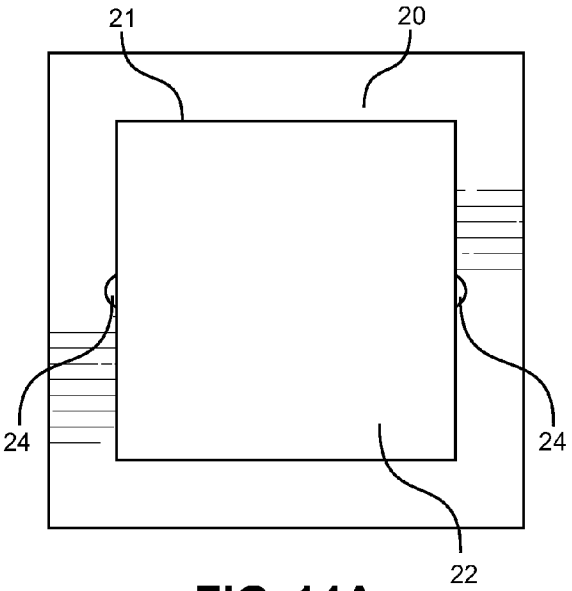

FIG. 14*a* shows a top view of the two recesses in a rectangular trim profile of a rectangular trim section.

Figure 14B:
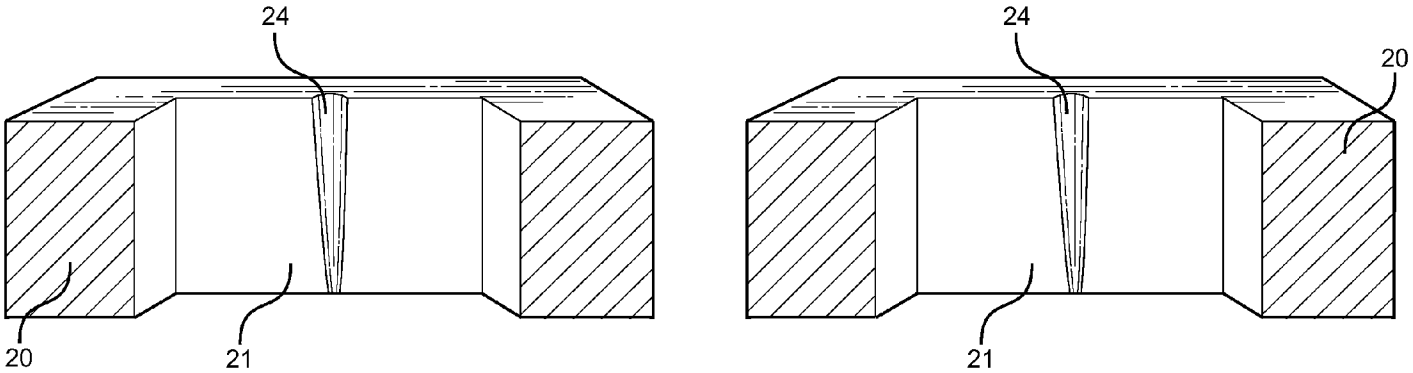

FIG. 14*b* shows a cross-sectional view of two recesses in a rectangular trim profile of a rectangular trim section.

DETAILED DESCRIPTION OF THE INVENTION

Reference is made herein to the attached drawings. Like reference numerals are used throughout the drawings to depict like or similar elements of the die trim assembly with a recess adapted to retain slugs in a stamping process. For the purposes of presenting a brief and clear description of the present invention, the preferred embodiment will be discussed as used for die trim section assembly with a recess. The figures are intended for representative purposes only and should not be considered to be limiting in any respect.

Figure 1:
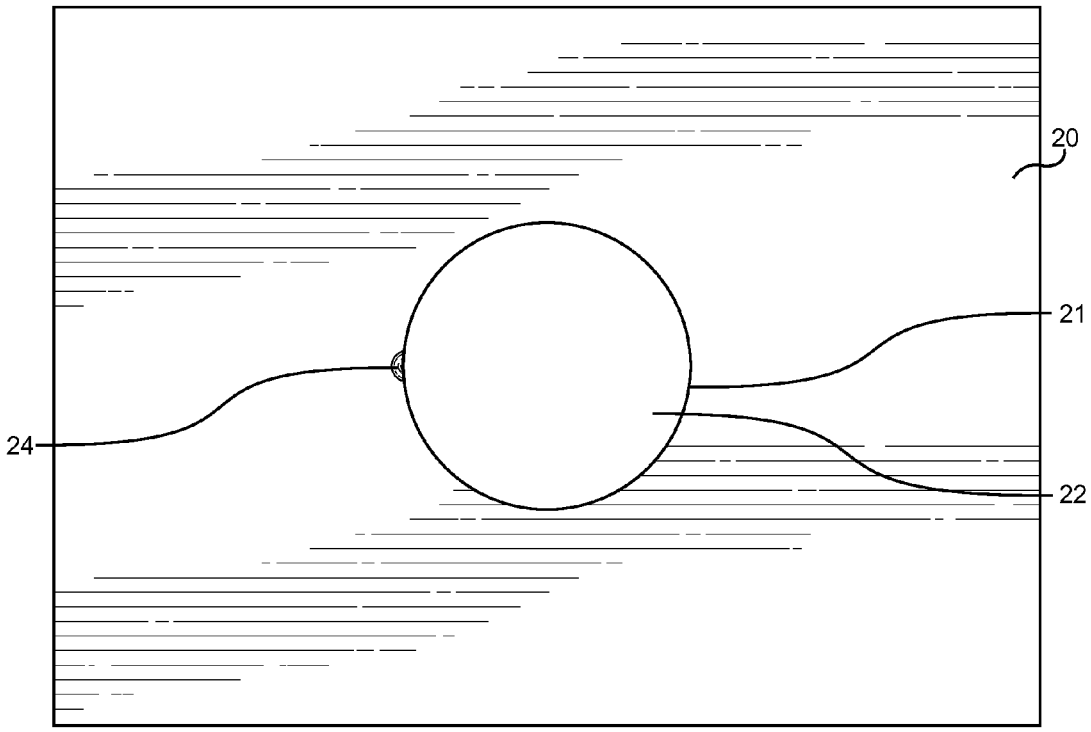
FIG. 1 is a top view of a trim section, with a hollow round trim profile having a recess located at one point around the trim profile

Referring now to FIG. 1, there is shown a simplified top view of the die trim insert 20 and the round die trim profile opening 22 with the recess 24. The die trim profile opening 22 is hollow and comprises a longitudinal central axis. The die trim profile opening 22 is adapted to receive a trim punch during a stamping process and catches a slug as the trim punch is withdrawn. The shape of the die insert opening 22 substantially matches the trim punch. The size of the die insert opening 22 is slightly larger to allow for cutting clearance. The size and shape of the slugs produced during the stamping process is also approximately equal to the die trim profile opening 22. The die trim profile opening 22 is at the die trim insert 20 level, which is the top surface of the die trim insert 20. The die trim profile opening 22 has an interior die trim profile wall 21, which is perpendicular to, and below the surface of the die trim insert 20. The die trim profile wall 21 may include one or more rounded wall surfaces, planar or substantially planar wall surfaces, or a combination thereof to define a desired die trim profile opening. The bottom surface of the die trim profile opening 22 opens into a cavity to allow the slugs to fall out of the bottom of the stamping die after being pushed through the trim profile opening 22. The recess 24 could be semi-conical or a semi-cylindrical that is approximately as deep horizontally at the top edge as the cutting clearance between the trim punch and the trim profile opening 22. The vertical length of the recess 24 should preferably exceed the depth that the trim punch enters into the die trim profile opening 22.

The recess 24 can be added to an existing die trim profile opening 22 and does not require new parts. The recess 24 may be added to the die trim profile wall 21 using one of various methods, depending upon the embodiment of the recess 24. One of the preferred cutting methods is wire or conventional EDM, which is used to add or retrofit a semi-conical embodiment of the recess 24 into a new or existing die trim profile opening 22. For a semi-cylindrical embodiment, conventional grinding method, wire EDM, or other suitable method may be used.

The recess 24 is preferably positioned vertically so that the top part of the recess 24 is level with the top surface of the die trim insert 20 and the bottom is below the depth that the trim punch enters the die trim profile opening 22. The bottom end of the recess 24 creates a pinching action and compresses a slug when the slug is pushed down with a trim punch into the die trim profile opening 22 during a stamping process. As a result, the slug is wedged against the die trim profile wall 21 and secured into place. The horizontal depth of recess 24 disposed on the die trim profile wall 21 depends upon the slug size and thickness, the composition of the stamped material, cutting clearance between trim punch and trim profile opening 22, and trim profile opening 22 design. The vertical length of the recess 24 depends upon amount of land in the die trim insert 20 and the distance that the trim punch travels into the trim profile opening 22.

Figure 2:
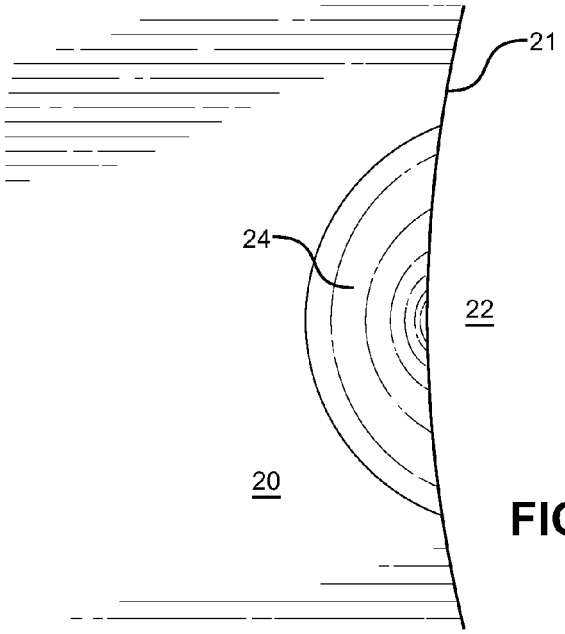
FIG. 2 is a close up top view of the recess on a round trim profile in FIG. 1.

Referring now to FIG. 2, there is shown a close up view of the recess 24 around the die trim profile opening 22 from the top in FIG. 1. The recess 24 is located at the outer edge of the die trim profile opening 22, and is cut into the die trim profile wall 21. The recess 24 creates a small geometrical tab or offshoot on the slug that is progressively pinched as it is pushed into the die trim profile opening 22 when a trim punch is stamped through a material, causing the slug to wedge thereagainst the die trim profile wall 21. Friction between the recess 24 and the geometric tab causes the tab to become wedged therein and therefore prevents the slug from being withdrawn from the die trim profile opening when the trim punch is removed. This prevents slugs from adhering to the surface of the trim punch as it is withdrawn from the die trim profile opening 22 and being drawn out of the die trim profile opening 22. The recess 24 can be added to die trim inserts of various shapes and depth.

The size and depth of the recess 24 depends on the size of the slug, the cutting clearance, the stamping material, and the trim punch depth into the die trim insert. For instance, a large slug stamped from a thick stamping material would require a larger recess compared to a recess for a smaller slug stamped from a thin stamping material. Furthermore, the vertical depth of the recess is preferably equal to or greater than the depth with which the slug will travel into the die trim profile opening 22. Thus, the vertical depth of the recess may be substantially equal to or more than the distance that the trim punch travels into the die insert opening 22. Additionally, more than one recess may be added to a die trim profile wall 21. The stamping material typically comprises of metal, but the present invention is not limited only to metal, and the present invention can be used when perforating holes and shapes in other materials.

Figure 3:
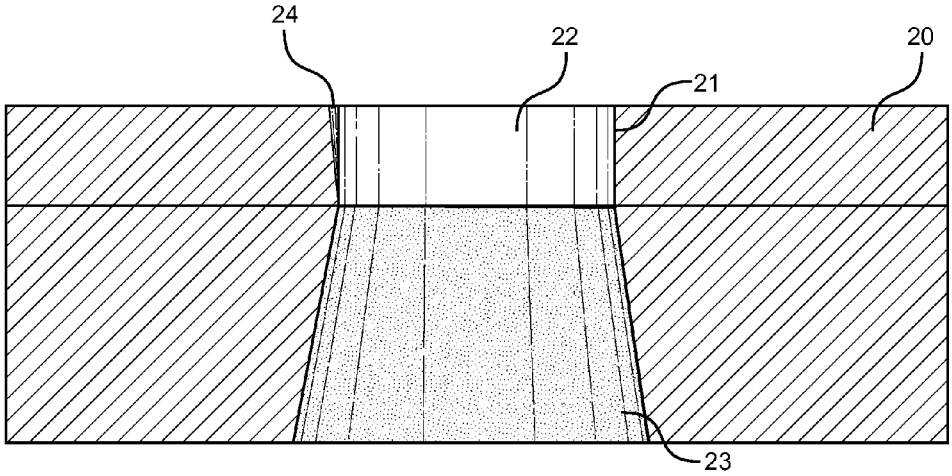
FIG. 3 is a side cross-sectional view of FIG. 1, showing the recess cut into the trim profile of the trim section.

Referring now to FIG. 3, there is shown a cross-sectional view of the die trim insert 20 in FIG. 1. In the illustrated embodiment, the recess is added via an angled cylindrical extrusion. In other embodiments, however, the recess 24 may be added via an angled conical extrusion, or a vertical conical extrusion into the die trim profile wall 21. Below the die trim profile opening 22 is a taper relief 23, which relieves pressure on the slugs, allowing them to fall out of the die trim insert 20. The size and the shape of the recess 24 generally depends on the cutting clearance between the trim punch and the die trim insert opening 22, and the distance that the trim punch travels into the die insert opening 22, and the stamping material. Generally, the recess 24 is approximately as deep horizontally into the top edge as the die insert cutting clearance. The vertical length of the recess 24 depends upon land depth and the distance the trim punch enters into the die insert opening 22, which is used to determine the angle of the recess into the die insert opening 22.

Referring now to FIG. 4, there is shown a side cross-sectional view of the die trim assembly including a sheet of stamping material 26 disposed over a die trim insert 20 and a trim punch 25 positioned in a die trim profile opening 22. The trim punch 25 is adapted to move in upwards and downwards along a vertical axis. The die trim profile opening 22 is aligned with the trim punch 25 such that the trim punch 25 enters the die trim profile opening 22 when it moves downwards. As the trim punch 25 moves downwards, it punches a hole or a shape through the stamping material 26 positioned over the die trim profile opening 22, creating a slug 27. As the trim punch 25 travels through the die trim profile opening 22, a recess 24 pinches the slug 27 and wedges it against the die trim profile wall 21 to be retained therein. In the illustrated embodiment, the die trim assembly includes two recesses 24, wherein each recess 24 extends below the die trim profile opening 22 and into the taper relief 23. The embodiment and configuration of the recess 24 may vary depending on the application. Alternatively, the slug 27 falls through the taper relief 23, disposed below the die trim profile opening 22. Additionally, the die trim assembly includes a punch stripper 28 that strips the stamping material 26 from the trim punch 25.

Referring now to FIG. 5, there is shown a side view of a first embodiment of the recess of the present invention, wherein the recess is created via a a vertical conical extrusion. More specifically, the recess is cut with a conical shape from an angle perpendicular to the cutting edge of the die trim insert 20 such that the side of the conical extruder is aligned with a vertical axis and parallel to the die trim profile wall 21. The recess has a larger diameter at an upper portion of the recess 24, and a smaller diameter at the lower end of the recess 24. The upper portion of the recess 24 is level with the cutting edge of the die trim insert 20 and the narrower lower end of the recess 24 extends below the lower end of the die trim profile opening 22 and into the taper relief 23. Accordingly, the length of the recess 24 extends through the die trim insert 20. The die trim insert 20 is above the die trim support block 29. Die trim support block 29 has an opening that is larger than die trim profile opening 22, which allows the slugs to fall out of the die after the slugs have been pushed through the die trim insert 20 by the trim punch 25. Additionally, the diameter of the recess 24 increases as it reaches the cutting edge of the die trim insert 20, and the diameter of the recess 24 decreases as it nears the taper relief 23 and the die trim support block 29 disposed below the die trim profile opening 22. The illustrated embodiment of the recess may be added to the existing die trim profile opening 22 by wire EDM. The recess pinches loose slugs as it is pushed down into the die trim profile opening 22.

Referring now to FIG. 6, there is shown a front cross-sectional view of the first embodiment of the recess 24 located on the die trim profile wall 21. In the illustrated embodiment, the recess 24 is aligned vertically and perpendicular to the top edge of the die trim insert 20. The tapered end of the recess 24 wedges a slug in the die trim profile opening 22 as it is driven towards the bottom of the land, stopping above the taper relief 23 by a trim punch. The recess 24 creates a lug on the side of the slug that becomes a pressure point on the slug that keeps it tight in the die trim profile opening 22, allowing the trim punch to withdraw and the slug to stay in the die trim profile opening 22, therefore allowing the die trim assembly to run unobstructed by slugs.

Referring now to FIG. 7, there is shown a close up front view of the first embodiment of the recess of the present invention. The recess forms a substantially V-shape when viewed from the front such that the widest part of the V is at the die trim insert 20 surface and the narrower part of the V is below the lower end of the die insert opening 22 and extends into the taper relief 23. The radius and depth of the recess 24 are dependent upon the size of the slug, cutting clearance, and the distance that the trim punch travels into the die insert opening 22. The recess 24 keeps the slug from being drawn upwards above the die trim insert 20 surface, or adhering to the surface of a trim punch when it is withdrawn from the die trim profile opening 22. The recess 24 creates a pinching action on the slug that creates a more positive slug locking pressure and helps to prevent loose slugs from being drawn upwards with the trim punch or tilting sideways after the trim punch is withdrawn. This keeps loose slugs from jamming the in-feeding material or causing the die tooling to break. Accordingly, the present invention keeps the die running more effectively and reduces maintenance costs.

Referring now to FIG. 8, there is shown a side view of a second embodiment of the present invention added via an angled conical extrusion. More specifically, the recess is cut with a side of the conical extruder that is tapered to less depth towards the bottom edge of the trim profile wall 21. In this embodiment, the recess 24 tapers to less depth as it nears the taper relief 23. Alternatively, the recess 24 may taper at the taper relief 23. Accordingly, the length of the recess 24 is less than, equal to, or greater than the depth of the die trim profile opening 22. The angled conical extrusion is added to new or existing the die trim profile opening 22 using wire EDM, or other suitable methods.

Referring now to FIG. 9, there is shown a front cross-sectional view of the second embodiment of the recess 24 located on the die trim profile wall 21. The second embodiment of the recess 24 is aligned substantially vertically. The top part of the recess 24 extends over the outer perimeter of the top of the die trim profile opening 22. The recess 24 is widest at the top, which is at the cutting edge of the trim profile wall 21. The recess is narrower towards its lower end, but it tapers out before it reaches the taper relief 23, which is positioned below the die trim profile opening 22. The slugs are retained in the die trim profile opening 22 and prevented from being withdrawn with the trim punch.

Referring now to FIG. 10, there is shown a close up front view of the second embodiment of the present invention. Radius, depth, and angle relative to the die trim profile opening 22 of the recess 24 are dependent upon the size of the slug, cutting clearance between the trim punch and the die trim profile wall 21, the distance the trim punch travels into the die trim profile 22, the amount of land, as well as the stamping material used. The recess 24 creates a small geometrical tab or lug on the slug that is progressively squeezed as it is pushed into the die trim insert 20. This prevents the slug from being withdrawn out of the die trim profile opening 22. The surface area of recess 24 decreases as the slug travels deeper into the trim profile opening 22, pinching the slug and locking it into place, which keeps the in-feeding material from jamming. This also prevents the tooling in the die from breaking and the finished products from being damaged by slugs in the working area of the die.

Referring now to FIG. 11, there is shown a view of the third embodiment of the present invention. The third embodiment is added via an angled cylindrical extrusion. In this embodiment, a cylindrical cut is used to create the recess 24 into the trim profile 21. The recess 24 is cut at an angle, wherein the central axis of the conical extruder is at an angle relative to the die trim profile wall 21. The top of the recess 24 cuts deeper into the top cutting edge of the trim profile wall 21 such that the top of the recess 24 extends past the outer perimeter of the die trim profile opening 22. In the illustrated embodiment, the recess 24 extends below the die trim profile opening 22, such that the recess 24 tapers out at the taper relief 23. Additionally, the cut is deeper into the top of the die trim profile wall 21 and is tapered to less depth at the bottom which is tapered out. The angled cylindrical extrusion may also be added to new or existing the die trim profile opening 22 using conventional grinding, wire EDM, or other suitable methods.

Referring now to FIGS. 12 and 13, there are shown frontal views of the third embodiment of the present invention created via an angled cylindrical extrusion. The recess 24 assumes the shape of the cylindrical cut, but the width and depth of the recess changes along its length. As such, the recess 24 captures slugs and prevents the slugs from jamming the in-feeding material. The cylindrical cut of the recess 24 has similar features as the previous embodiments. This embodiment also creates a small lug on the slug, which takes the shape of the recess at the top cutting edge. The area of the recess 24 decreases towards the bottom of the recess 24. The lug that is created near the top of the recess 24 is driven to the bottom of the recess 24, where the area of the recess 24 is now smaller. This creates a pinching action on the slug itself.

Referring now to FIGS. 14*a* and 14*b*, there are shown an embodiment of the present invention in a rectangular die trim profile opening 22. Two recesses 24 are added to the die trim profile wall 21 at two different points in a rectangular embodiment of the die trim profile opening 22. As discussed above, one or more recess 24 may be added to die trim profile opening 22 of various shapes and sizes. The number of the recess 24 required for the die trim profile opening 22 depends upon the slug size and metal thickness. Generally, more recesses are needed for larger and thicker slugs. Each recess in the disclosed embodiment creates a geometrical tab that allows the configuration of the recess 24 and the die trim profile wall 21 to exert pressure on tabs and the slug to rigidly wedge the slug into the die trim profile wall 21 at the bottom of the punch stroke. Eventually, the slugs are pushed free downward and fall out of the bottom of the die trim insert 20.

It is therefore submitted that the instant invention has been shown and described in what is considered to be the most practical and preferred embodiments. It is recognized, however, that departures may be made within the scope of the invention and that obvious modifications will occur to a person skilled in the art. With respect to the above description then, it is to be realized that the optimum dimensional relationships for the parts of the invention, to include variations in size, materials, shape, form, function and manner of operation, creation of recess, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A stamping slug retention assembly adapted for a stamping operation, comprising:

a die trim section having a die trim profile opening with interior trim profile walls and a taper relief disposed below the die trim profile opening, said die trim profile opening having a longitudinal central axis;

wherein said die trim profile opening is adapted to receive a trim punch and retain a slug after said trim punch is withdrawn from said die trim profile opening;

at least one recess along an edge of said die trim profile opening;

wherein a radius of the recess tapers towards the taper relief, such that a width of the recess narrows towards the taper relief; wherein the recess extends at least to a boundary between the taper relief and the die trim profile opening;

wherein a longitudinal axis of the recess is disposed parallel to a direction of movement of the trim punch;

wherein said recess top end is disposed along said upper surface of said die trim section and along said edge of said die trim profile opening, and said recess bottom end is disposed along said interior die trim profile insert walls such that said recess is adapted to create a geometrical tab on an edge of a slug, which is progressively wedged against said recess as said slug is pushed into said die trim profile opening, thereby preventing said slug from being withdrawn from said die trim profile opening when said trim punch is removed.

2. The stamping slug retention assembly of claim 1, wherein said recess is shaped by a conical extruder having a central axis defined at an angle relative to said interior trim profile walls, wherein a side of said conical extruder is positioned parallel to said interior trim profile walls.

3. The stamping slug retention assembly of claim 1, wherein said recess is shaped by a conical extruder having a central axis defined at an angle relative to said interior trim profile walls, wherein a side of said conical extruder is positioned at an angle relative to said interior trim profile walls.

4. The stamping slug retention assembly of claim 1, wherein said recess is shaped by a cylindrical extruder having a central axis defined at an angle relative to said interior trim profile walls, wherein said cylindrical extruder central axis is positioned at said angle.

5. The stamping slug retention assembly of claim 1, wherein a height of said recess is less than a distance that said trim punch travels into said die trim profile opening.

6. The stamping slug retention assembly of claim 1, wherein a height of said recess is substantially equal to a distance that said trim punch travels into said die trim profile opening.

7. The stamping slug retention assembly of claim 1, wherein a height of said recess is greater than a distance that said trim punch travels into said die trim profile opening.

8. The stamping slug retention assembly of claim 1, wherein the radius that tapers towards the taper relief is a depth of said recess.

9. The stamping slug retention assembly of claim 1, wherein the radius that tapers towards the taper relief is a width of said recess.

10. The stamping slug retention assembly of claim 1, wherein said recess is created on an existing die trim section.

11. The stamping slug retention assembly of claim 1, wherein said recess is created in a new die trim section.

12. The stamping slug retention assembly of claim 1, wherein said die trim profile opening comprises at least one substantially rounded profile wall.

13. The stamping slug retention assembly of claim 1, wherein said die trim profile opening comprises at least one substantially planar profile wall.

14. The stamping slug retention assembly of claim 1, wherein said die trim profile opening comprises a rounded die trim profile opening.

15. The stamping slug retention assembly of claim 1, wherein said die trim profile opening comprises a rectangular die trim profile opening.

16. The stamping slug retention assembly of claim 1, further comprising a taper relief below said die trim profile opening.

* * * * *